US007506446B2

(12) United States Patent
Onion

(10) Patent No.: US 7,506,446 B2
(45) Date of Patent: Mar. 24, 2009

(54) LOCKING MECHANISM FOR A FOLDING KNIFE

(75) Inventor: Kenneth J. Onion, Kaneohe, HI (US)

(73) Assignee: KAI U.S.A., Ltd., Tualatin, OR (US)

( * ) Notice: Subject to any disclaimer, the term of this patent is extended or adjusted under 35 U.S.C. 154(b) by 138 days.

(21) Appl. No.: 10/825,848

(22) Filed: Apr. 16, 2004

(65) Prior Publication Data

US 2005/0229401 A1 Oct. 20, 2005

(51) Int. Cl.
*B26B 1/04* (2006.01)
*B26B 1/00* (2006.01)

(52) U.S. Cl. ..... 30/160; 30/161

(58) Field of Classification Search ..... 30/155, 30/158, 159, 160, 161, 330, 331; 7/118; 403/79, 80, 82, 116, 245, 254, 263, 293, 403/316, 387, 399, 93, 95
See application file for complete search history.

(56) References Cited

U.S. PATENT DOCUMENTS

| | | | |
|---|---|---|---|
| 23,975 | A | 5/1859 | Belcher |
| 57,902 | A | 9/1866 | Hibbard |
| 226,910 | A | 4/1880 | Friebertshauser |
| 338,251 | A | 3/1886 | Crandall et al. |
| 382,967 | A | 5/1888 | Fullerton |
| 530,792 | A | 12/1894 | Nordlow |
| 551,052 | A | 1/1895 | Waldron et al. |
| 552,928 | A | 1/1896 | Russell |
| 557,760 | A | 4/1896 | Brauer |
| 577,593 | A | 2/1897 | Bronson et al. |
| 600,442 | A | 3/1898 | Nell |
| 616,689 | A | 12/1898 | Ruettgers |
| 749,230 | A | 1/1904 | Severance |
| 777,358 | A | 12/1904 | Week |
| 1,189,005 | A | 6/1916 | Seely |
| 1,315,503 | A | 9/1919 | Hughes |
| 1,319,532 | A | 10/1919 | Rasmussen |
| 1,357,398 | A | 11/1920 | Haywood |
| 1,412,373 | A | 4/1922 | Shields |
| 1,440,793 | A | 1/1923 | Rasmussen |
| 1,454,665 | A | 5/1923 | Bobek |
| 1,515,688 | A | 11/1924 | Love |
| 1,584,165 | A | 5/1926 | Brown |
| 1,603,914 | A | 10/1926 | Hermann |

(Continued)

FOREIGN PATENT DOCUMENTS

| | | |
|---|---|---|
| DE | 1104386 | 1/1960 |

(Continued)

*Primary Examiner*—Boyer D. Ashley
*Assistant Examiner*—Edward Landrum
(74) *Attorney, Agent, or Firm*—Seed IP Law Group PLLC

(57) ABSTRACT

A folding knife with a locking mechanism, and a method of assembly of the locking mechanism are disclosed. In one embodiment, the locking mechanism is formed from a second locking element slidably mounted on the blade to engage at least part of a first locking element on the handle and lock the blade in the open position. The second locking element and blade may be configured to allow simple, one-handed locking and unlocking of the blade with a single thumb-actuated motion. The second locking element also may be configured to allow one-handed opening and/or closing of the blade.

37 Claims, 6 Drawing Sheets

U.S. PATENT DOCUMENTS

| | | | | | |
|---|---|---|---|---|---|
| 1,614,949 | A | | 1/1927 | Finley | |
| 1,701,027 | A | | 2/1929 | Brown | |
| 1,743,022 | A | | 1/1930 | Carman | |
| 1,810,031 | A | | 6/1931 | Schrade | |
| 1,864,011 | A | | 6/1932 | Brown | |
| 2,286,524 | A | | 6/1942 | Wilbur | |
| 2,304,601 | A | | 12/1942 | Schrade | |
| 2,407,897 | A | | 9/1946 | Newman | |
| 2,569,080 | A | | 9/1951 | Trimble et al. | 30/320 |
| 2,596,294 | A | | 5/1952 | Schrade | |
| 2,736,959 | A | | 3/1956 | Simon et al. | |
| 3,079,784 | A | | 3/1963 | Pavioski | 70/456 |
| 3,404,456 | A | | 10/1968 | Chilko | 30/155 |
| 3,868,774 | A | | 3/1975 | Miori | |
| 4,040,181 | A | | 8/1977 | Johnson | |
| 4,133,106 | A | | 1/1979 | Addis | |
| 4,148,140 | A | | 4/1979 | Lile | |
| 4,173,068 | A | | 11/1979 | Cargill | |
| 4,218,819 | A | | 8/1980 | Phelps | |
| 4,240,201 | A | | 12/1980 | Sawby et al. | |
| 4,268,960 | A | | 5/1981 | Reinschreiber | |
| 4,274,200 | A | | 6/1981 | Coder | |
| 4,322,885 | A | | 4/1982 | Osada | |
| 4,347,665 | A | | 9/1982 | Glesser | |
| 4,356,631 | A | | 11/1982 | Guth | |
| 4,404,748 | A | | 9/1983 | Wiethoff | |
| 4,439,922 | A | | 4/1984 | Sassano | |
| 4,442,600 | A | | 4/1984 | Felix-Dalichow | |
| 4,451,982 | A | | 6/1984 | Collins | |
| 4,502,221 | A | | 3/1985 | Pittman | |
| 4,541,175 | A | | 9/1985 | Boyd et al. | |
| 4,570,341 | A | | 2/1986 | Konneker | |
| 4,604,803 | A | | 8/1986 | Sawby | |
| 4,612,706 | A | | 9/1986 | Yunes | |
| 4,670,984 | A | | 6/1987 | Rickard | |
| 4,719,700 | A | | 1/1988 | Taylor, Jr. | 30/158 |
| 4,741,106 | A | | 5/1988 | Yamagishi | |
| 4,776,094 | A | | 10/1988 | Glesser | |
| 4,802,279 | A | | 2/1989 | Rowe | 30/155 |
| 4,805,303 | A | | 2/1989 | Gibbs | |
| 4,811,486 | A | | 3/1989 | Cunningham | |
| 4,837,932 | A | | 6/1989 | Elsener | |
| 4,893,409 | A | * | 1/1990 | Poehlmann | 30/161 |
| 4,896,424 | A | | 1/1990 | Walker | |
| 4,947,552 | A | | 8/1990 | Barnes | |
| 4,974,323 | A | | 12/1990 | Cassady | |
| 4,979,301 | A | * | 12/1990 | Walker | 30/161 |
| 5,044,079 | A | | 9/1991 | Gibbs | |
| 5,060,379 | A | * | 10/1991 | Neely | 30/161 |
| 5,092,045 | A | | 3/1992 | Boyd, Jr. et al. | |
| 5,095,624 | A | | 3/1992 | Ennis | |
| 5,111,581 | A | | 5/1992 | Collins | |
| 5,131,149 | A | | 7/1992 | Thompson et al. | 30/161 |
| D336,602 | S | | 6/1993 | Thompson et al. | D8/99 |
| D338,386 | S | | 8/1993 | Frazer | D8/105 |
| 5,293,690 | A | | 3/1994 | Cassady | |
| D345,688 | S | | 4/1994 | McLean et al. | D8/356 |
| D348,599 | S | | 7/1994 | Sakai | |
| 5,325,588 | A | | 7/1994 | Rogers | |
| 5,331,741 | A | | 7/1994 | Taylor, Jr. | 30/158 |
| 5,400,509 | A | | 3/1995 | Collins | |
| 5,425,175 | A | | 6/1995 | Rogers | |
| 5,437,101 | A | | 8/1995 | Collins | |
| 5,461,786 | A | | 10/1995 | Miller | |
| 5,467,256 | A | | 11/1995 | Chen | |
| D365,266 | S | | 12/1995 | Hasegawa | D8/99 |
| 5,493,781 | A | | 2/1996 | Saito | |
| D367,807 | S | | 3/1996 | Hung | D8/105 |
| 5,502,895 | A | | 4/1996 | Lemaire | |
| 5,511,310 | A | | 4/1996 | Sessions et al. | |
| 5,515,610 | A | | 5/1996 | Levin et al. | |
| 5,537,750 | A | | 7/1996 | Seber et al. | |
| 5,546,662 | A | | 8/1996 | Seber et al. | |
| D373,296 | S | | 9/1996 | Thompson | |
| 5,581,895 | A | | 12/1996 | Jeffcoat | 30/294 |
| 5,596,808 | A | | 1/1997 | Lake et al. | |
| D377,744 | S | | 2/1997 | Hasegawa | D8/99 |
| 5,615,484 | A | | 4/1997 | Pittman | |
| 5,647,129 | A | | 7/1997 | Stamper | |
| D384,871 | S | | 10/1997 | McWillis | D8/99 |
| 5,685,079 | A | | 11/1997 | Brothers et al. | |
| 5,689,885 | A | | 11/1997 | Walston | |
| 5,692,304 | A | | 12/1997 | Campbell | |
| 5,699,615 | A | | 12/1997 | Chen | |
| D389,718 | S | | 1/1998 | Wegner | D8/99 |
| D392,539 | S | | 3/1998 | Balolia | D8/99 |
| 5,737,841 | A | | 4/1998 | McHenry et al. | |
| 5,755,035 | A | | 5/1998 | Weatherly | |
| 5,781,998 | A | | 7/1998 | Stamper | |
| 5,794,346 | A | | 8/1998 | Seber et al. | 30/161 |
| 5,802,722 | A | | 9/1998 | Maxey et al. | 30/160 |
| D399,113 | S | | 10/1998 | Balolia | D8/99 |
| 5,815,927 | A | | 10/1998 | Collins | |
| 5,819,414 | A | | 10/1998 | Marifone | |
| 5,822,866 | A | | 10/1998 | Pardue | |
| 5,826,340 | A | | 10/1998 | Hull | |
| 5,839,194 | A | | 11/1998 | Bezold | |
| D402,178 | S | | 12/1998 | Glesser | D8/99 |
| 5,845,404 | A | | 12/1998 | Jeffcoat | 30/125 |
| 5,875,552 | A | | 3/1999 | Chen | |
| 5,887,347 | A | | 3/1999 | Gibbs | |
| D407,961 | S | | 4/1999 | Balolia | D8/99 |
| 5,964,036 | A | | 10/1999 | Centofante | |
| 5,966,816 | A | | 10/1999 | Roberson | |
| 6,079,106 | A | | 6/2000 | Vallotton | |
| 6,122,829 | A | | 9/2000 | McHenry et al. | |
| 6,125,543 | A | | 10/2000 | Jhones | |
| 6,145,202 | A | | 11/2000 | Onion | 30/160 |
| D434,631 | S | | 12/2000 | Lum | D8/99 |
| 6,154,965 | A | * | 12/2000 | Sakai | 30/161 |
| 6,158,127 | A | | 12/2000 | Taylor | 30/158 |
| 6,233,769 | B1 | | 5/2001 | Seber et al. | |
| D444,685 | S | | 7/2001 | Shenkel et al. | D8/18 |
| 6,256,888 | B1 | | 7/2001 | Shuen | |
| 6,276,063 | B1 | | 8/2001 | Chen | |
| 6,289,592 | B1 | | 9/2001 | Emerson | |
| 6,308,420 | B1 | * | 10/2001 | Moser | 30/161 |
| 6,338,431 | B1 | * | 1/2002 | Onion | 30/161 |
| 6,363,615 | B1 | | 4/2002 | Moser | |
| 6,378,214 | B1 | * | 4/2002 | Onion | 30/161 |
| 6,397,477 | B1 | | 6/2002 | Collins | |
| 6,427,334 | B2 | * | 8/2002 | Onion | 30/161 |
| 6,427,335 | B1 | | 8/2002 | Ralph | |
| 6,430,816 | B2 | | 8/2002 | Neveux | |
| 6,434,831 | B2 | | 8/2002 | Chen | |
| 6,438,848 | B1 | | 8/2002 | McHenry et al. | |
| D462,582 | S | | 9/2002 | Parlowski | D7/649 |
| D466,422 | S | | 12/2002 | Luquire | D10/62 |
| 6,490,797 | B1 | * | 12/2002 | Lake et al. | 30/161 |
| 6,523,265 | B2 | * | 2/2003 | Eickhorn | 30/161 |
| 6,553,671 | B2 | | 4/2003 | Blanchard | |
| 6,560,877 | B2 | | 5/2003 | Sanelli | 30/340 |
| 6,574,869 | B1 | | 6/2003 | McHenry et al. | |
| 6,591,504 | B2 | | 7/2003 | Onion | |
| 6,651,344 | B2 | | 11/2003 | Cheng | 30/159 |
| 6,684,510 | B1 | | 2/2004 | Collins | |
| 6,685,379 | B2 | * | 2/2004 | Polevoy et al. | 403/316 |
| 6,751,868 | B2 | | 6/2004 | Glesser | |
| 2002/0000042 | A1 | | 1/2002 | Glesser et al. | |
| 2002/0157260 | A1 | | 10/2002 | Cheng | |
| 2003/0070299 | A1 | | 4/2003 | Frazer | |
| 2004/0134075 | A1 | | 7/2004 | Chu | |

2004/0158991 A1 8/2004 Freeman

FOREIGN PATENT DOCUMENTS

| | | |
|---|---|---|
| DE | 1 104 386 | 4/1961 |
| EP | 0 230 000 | 7/1987 |
| FR | 493 741 | 8/1919 |
| FR | 1069862 | 1/1953 |
| FR | 1 171 740 | 1/1959 |
| FR | 1248117 | 10/1959 |
| FR | 1 248 117 | 10/1960 |
| FR | 2 705 606 | 12/1994 |
| JP | 4-30979 | 2/1992 |
| JP | 5-185381 | 7/1993 |
| TW | 569902 | 1/2004 |

* cited by examiner

LOCKING MECHANISM FOR A FOLDING KNIFE

TECHNICAL FIELD

The present disclosure relates generally to a folding knife, and particularly to a folding knife with a locking mechanism that locks the blade in an open position.

BACKGROUND

Folding knives enjoy wide popularity, particularly among sportsmen, campers, hikers, and many others engaged in outdoor activities. Common elements to folding knives include a handle and a blade pivotally connected to an end of the handle so that the blade pivots with respect to the handle between an open position in which the blade is extended away from the handle and a closed position in which the blade is at least partially received within the handle. Many folding knives also include a locking mechanism to maintain the blade in an open position.

Examples of folding knives, including folding knives with locking mechanisms, may be found in U.S. Pat. Nos. 1,454,665; 1,743,022; 4,040,081; 4,404,748; 4,451,982; 4,502,221; 4,719,700; 4,805,303; 4,811,486; 4,837,932; 4,893,409; 4,974,323; 4,979,301; 5,044,079; 5,060,379; 5,095,624; 5,111,581; 5,293,690; 5,325,588; 5,331,741;5,425,175; 5,502,895; 5,515,610; 5,537,750; 5,615,484; 5,685,079; 5,689,885; 5,692,304; 5,737,841; 5,755,035; 5,802,722; 5,822,866; 5,826,340; 5,887,347; 5,964,036; 6,079,106; 6,154,965; 6,338,431; 6,378,214; 6,427,335; and 6,438,848; and U.S. Patent Application Nos. 2002/0157260 and 2003/0070299, the entire disclosures of which are herein incorporated by reference for all purposes.

A simple mechanism for locking and unlocking the blade of a folding knife, particularly one that may be operated with a single thumb-actuated motion while the user's hand is holding the knife, may enhance the utility of the knife. That mechanism may be of further utility if it also may be used for one-handed opening and/or closing of the blade.

SUMMARY

A folding knife with a locking mechanism, and a method of assembly of the locking mechanism are described. In one embodiment, a locking mechanism is formed from a second locking element slidably mounted on the blade to engage at least part of a first locking element on the handle and lock the blade in the open position. The second locking element and blade may be configured to allow simple, one-handed locking and unlocking of the blade with a single thumb-actuated motion. The second locking element also may be configured to allow one-handed opening and/or closing of the blade.

DETAILED DESCRIPTION

Figure 1:
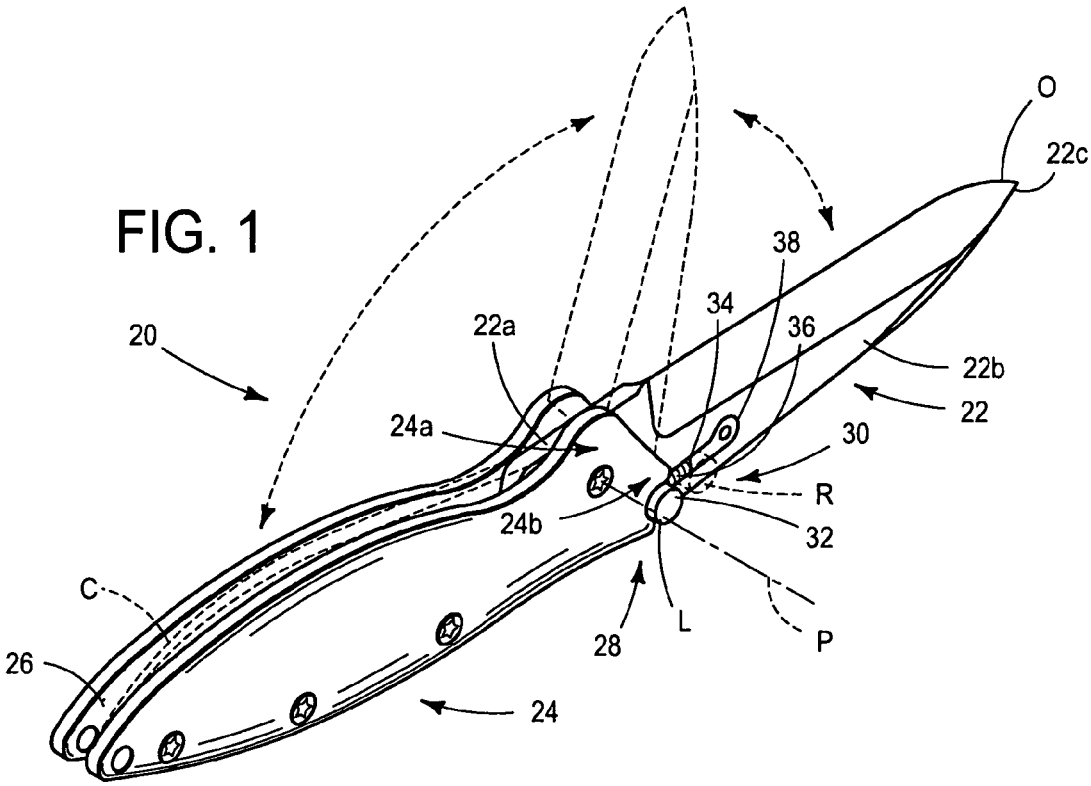
FIG. 1 is an isometric view of a folding knife incorporating a locking mechanism.
Figure 2:
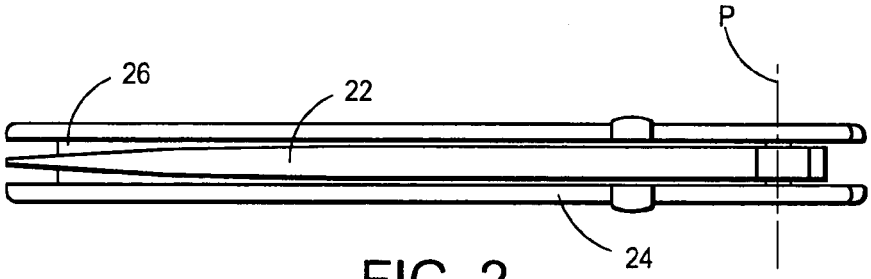
FIG. 2 is a front plan view of the knife of FIG. 1, showing the knife blade stored within a blade-receiving channel in the handle.
Figure 3:
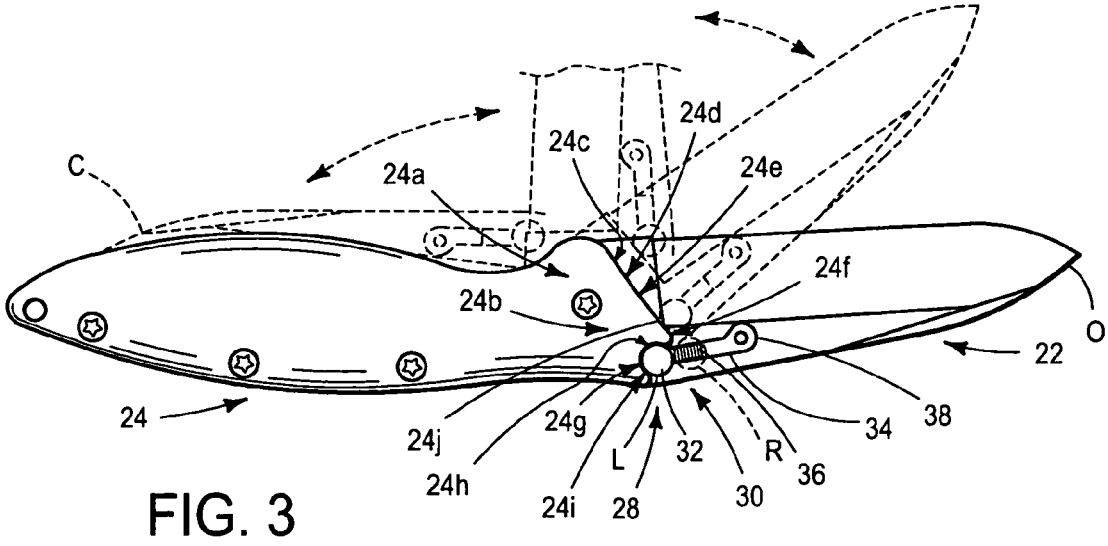
FIG. 3 is a side view of the folding knife of FIG. 1, showing pivoting of the blade between open and closed positions.

FIGS. 1-3 depict an embodiment of a folding knife 20 having a blade 22, a handle 24 defining a blade-receiving channel 26, and a locking mechanism 28. Blade 22 includes a tang 22*a* pivotally connected to an end 24*a* of handle 24. The blade pivots with respect to the handle about a pivot axis P between an open position O and a closed position C. In the open position, the blade is extended away from the handle so that it is deployed and ready for use. From the open position, the blade may be folded towards the handle into the closed position, in which the blade may be at least partially received for storage within blade-receiving channel 26 defined in the handle. In the closed position, blade 22 extends along handle 24.

Locking mechanism 28 may include a first locking element 24*b* and a second locking element 30. First locking element 24*b* may include any structure configured to engage second locking element 30 and lock blade 22 in the open position. For example, as shown in FIGS. 1 and 3, the first locking element may be formed from an end face 24*c* and/or an exposed exterior edge surface 24*d* of handle end 24*a*. Alternatively, or additionally, at least part of the first locking element may be attached to that end face and/or that edge surface on one or both sides of handle 24. First locking element 24*b* may include an angled end portion 24*e*, a locking portion 24*g*, and a corner 24*f* separating those two portions. Locking portion 24*g* may include a latching corner 24*h*, and/or a notched corner 24*i* configured to receive second locking element 30. Although the exemplary first locking element 24*b* is discussed as including a latching corner and/or notched corner formed on the handle end, virtually any other suitable structure configured to interact with at least part of second locking element 30 to selectively lock blade 22 in the open position may be used, such as latching elements, locking cutouts, holes, notches, or mechanical, magnetic, or electronic devices, or the like.

Second locking element 30 may include any structure configured to lock blade 22 in the open position. The second locking element also may be configured to open and/or close the blade. For example, as shown in FIGS. 1 and 3, the second locking element may include a post 32. The post may extend transversely from a flat surface 22*b* of blade 22 and may be positioned near blade tang 22*a*. Post 32 also may be spaced from pivot axis P so that the post is exposed during the rotation of blade 22 between the open and closed positions. Post 32 may be mounted for sliding movement in a slot 34 defined through blade 22 so that the post slides along the surface of the blade. Post 32 may be slidable in slot 34 between a first or locking position L at one end of the slot and a second or retracted position R at the other end of the slot, the locking position being spaced further from a blade point 22*c* compared to the retracted position.

FIG. 3 shows the interaction of post 32 with end face 24*c* as the blade is pivoted with respect to the handle, including the locking of the blade in open position O. As blade 22 is rotated from the closed position towards the open position, post 32 may remain spaced apart from end face 24*c* until it engages angled end portion 24*e* at an engagement position 24*i*. The engagement position may be varied by varying the shape of angled end portion 24*e*. For example, the angled end portion may be configured such that post 32 does not engage handle end 24*a* until the blade is at least approximately 75% towards the open position from the closed position. Other configurations for angled end portion 24*e* are possible and may be used.

With further rotation of blade 22, post 32 may pass around corner 24*h* and into locking portion 24*g* of handle end 24*a*. While post 32 is maintained in locking position L, locking portion 24*g* of handle end 24*a* may block the post and thus prevents blade 22 from being pivoted towards closed position C. The interaction between post 32 and handle end 24*a* may provide for a smooth opening of blade 22, while still providing feedback to the user that blade 22 has been locked in the open position by movement of post 32 into the locking position.

To unlock blade 22, post 32 may be pushed towards retracted position R to disengage the post from locking portion 24*g* of handle end 24*a*. Once post 32 and locking portion 24*g* are disengaged, handle end 24*a* no longer blocks the post, and blade 22 may be pivoted towards the closed position.

Figure 4:
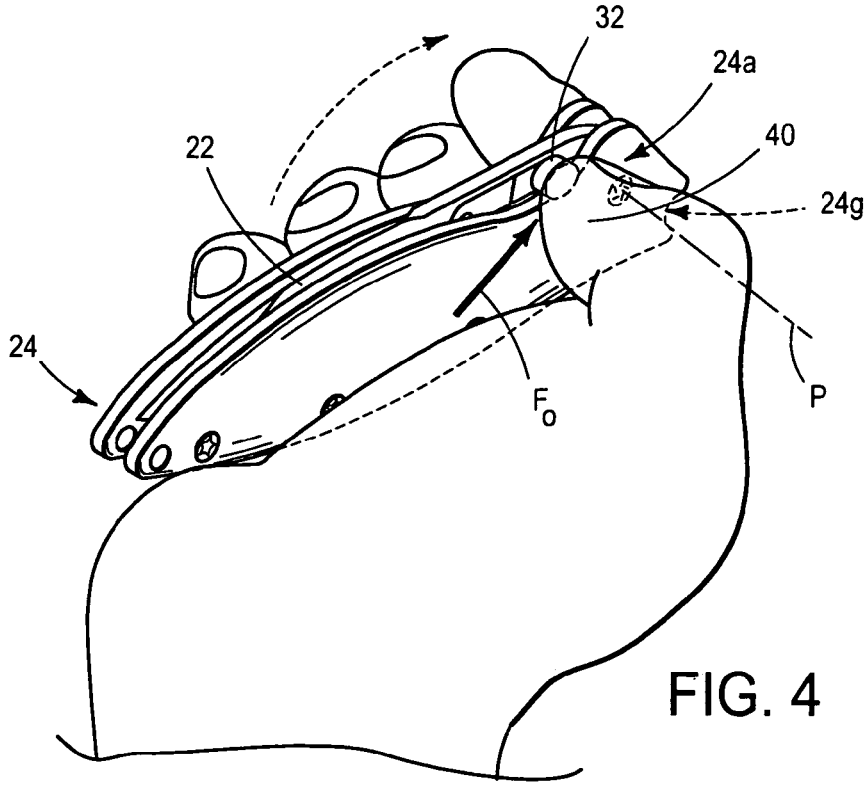
FIG. 4 is an isometric view showing the thumb of a user's hand positioned for opening and locking the blade of the knife of FIG. 1.

FIG. 4 depicts the folding knife of FIGS. 1-3 being opened by a user's hand. As will be appreciated from this and the preceding figures, post 32 may be positioned on blade 22 so that it is exposed for manipulation by a user throughout the entire range of the blade's pivotal travel. Because post 32 may extend transversely from the blade and may be spaced from pivot axis P, an external force parallel to the plane of the blade may be exerted upon the post to cause the blade to pivot with respect to the handle.

Thumb 40 may exert an opening force $F_o$ on post 32 to cause blade 22 to pivot towards the open position. As indicated, the position of the post may allow the blade to be easily opened with one hand with a simple thumb-actuated motion. Additionally, the depicted knife may be provided with an actuating bias element operatively connecting the handle to the blade, such as described in U.S. Pat. No. 6,378,214, to further facilitate opening and/or closing of the blade.

Figure 5:
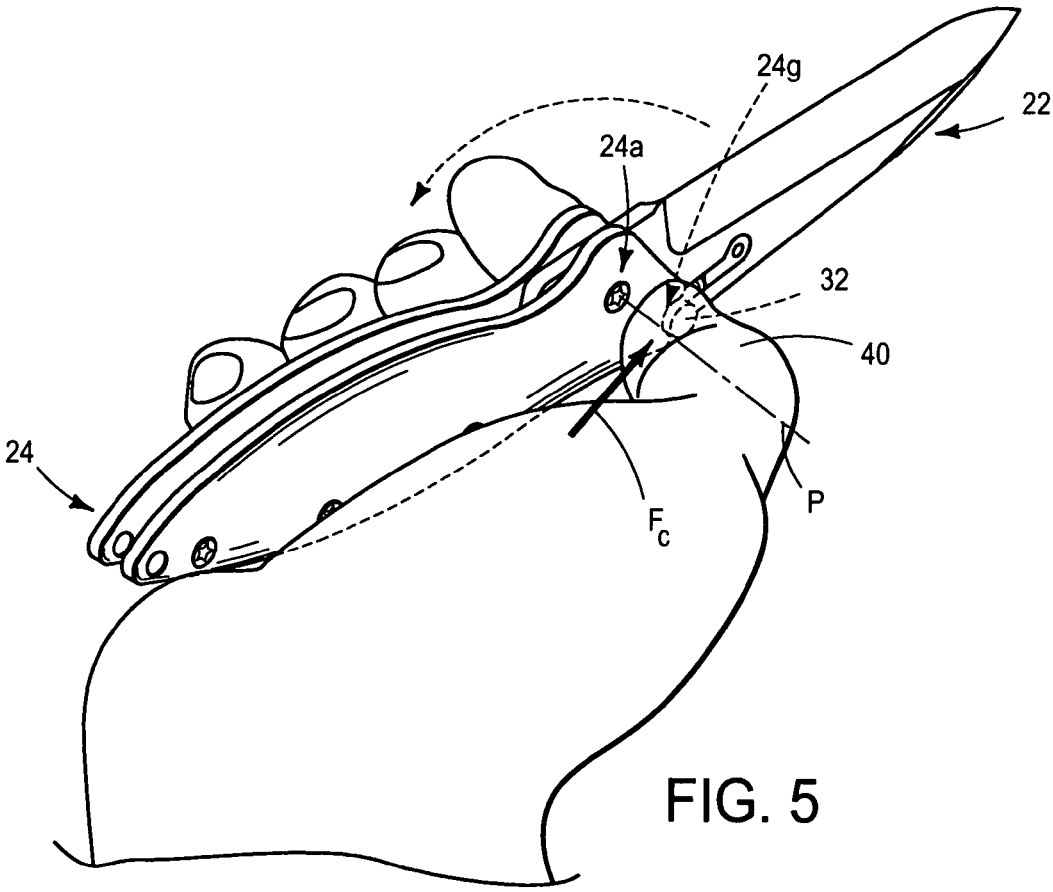
FIG. 5 is an isometric view showing a user's hand positioned for unlocking and closing the blade of the knife of FIG. 1.

As shown in FIG. 5, a similar motion may be used to unlock blade 22 and rotate the blade from the open position into the closed position. Thumb 40 is shown to exert a closing/unlocking force $F_c$ upon post 32 to move the post toward retracted position R sufficiently to disengage the post from locking portion 24*g* of handle end 24*a*, allowing the blade to be rotated towards the closed position.

Figure 6:
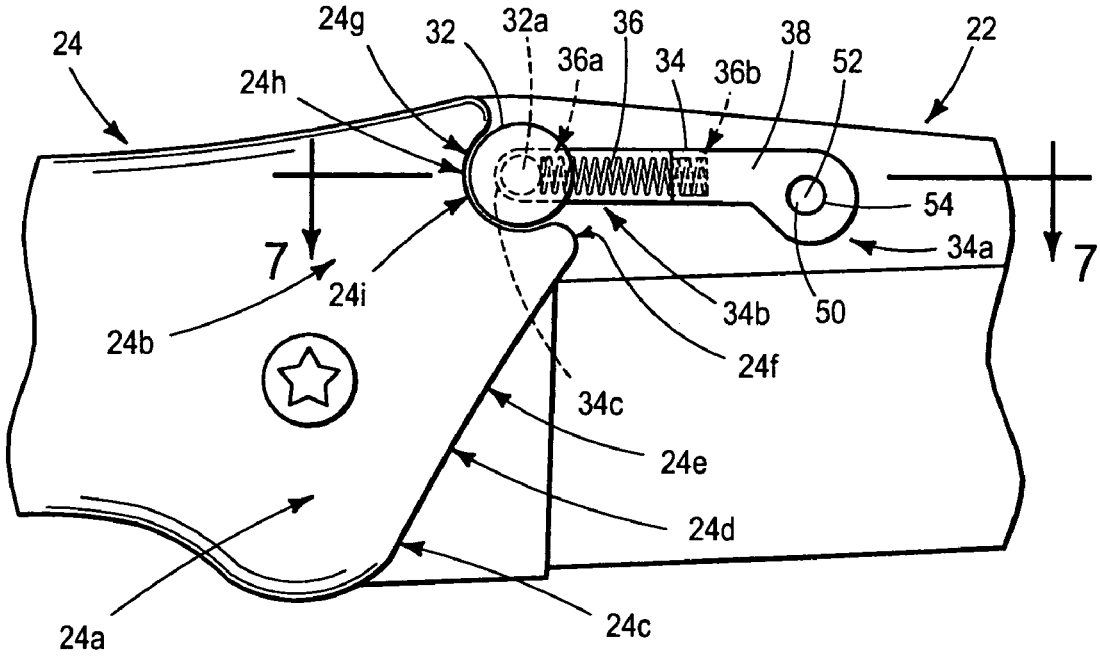
FIG. 6 is an enlarged, fragmentary side view of a knife incorporating the blade locking mechanism of FIG. 1.
Figure 7:
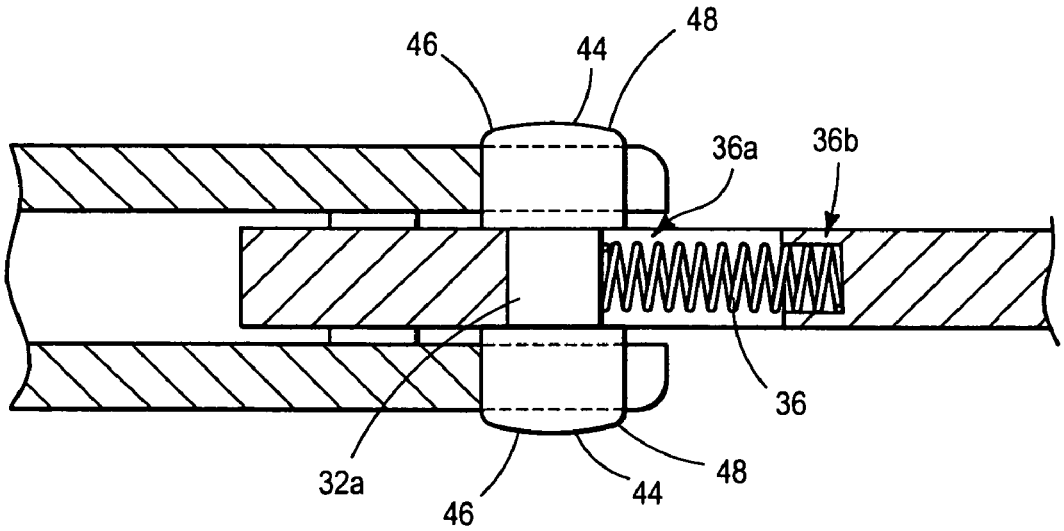
FIG. 7 is a partially sectioned top view of the folding knife taken along line 7-7 shown in FIG. 5.

As shown in FIGS. 6 and 7, post 32 may include a neck or pin 32*a*. Post 32 also may include one or more retainers 44 that may retain pin 32*a* in slot 34, provide a bearing surface by a user, and/or act as roller bearings. During opening, retainers 44 may roll as they bear against handle end 24*a* from engagement position 24*j* through corner 24*f* and into locking portion 24*g*, thereby preventing any scratching or wearing of the handle end, and improving the smoothness of the locking mechanism. This same benefit may be operative during blade closing, except that the order in which portions of handle end 24*a* may be encountered by retainers 44 would be reversed.

Retainers 44 and pin 32*a* may collectively define a stacked-disk shape where the retainers extend co-axially on the ends of the pin, as shown in FIG. 7. A post having that shape has been found to be easily engaged by the thumb of a hand, without the thumb rolling off the retainers. Retainers 44 may include enlarged knobs 46 and/or enlarged ends 48 that may be attached to or integral with pin 32*a*. For example, the retainers may be pressed, swaged, or welded, and/or the reduced diameter neck region of pin 32*a* may be machined from larger stock. The pin and retainers may roll together, or may be rotatably mounted on the pin so that the retainers may roll around the pin.

Slot 34 may include a wide or first portion 34*a* and a narrow or second portion 34*b*, as shown in FIG. 6. First portion 34*a* may be configured to receive at least one of the retainers 44. Second portion 34*b* may be sized larger in width than the diameter of pin 32*a* of post 32 to accommodate that pin, but smaller in width than the diameter of retainers 44 to prevent passage of those retainers laterally. Thus, post 32 may be slidably located in slot 34 by inserting one of the retainers 44 into first portion 34*a* and then sliding pin 32*a* through second portion 34*b* towards a slot end 34*c*.

Figure 8:
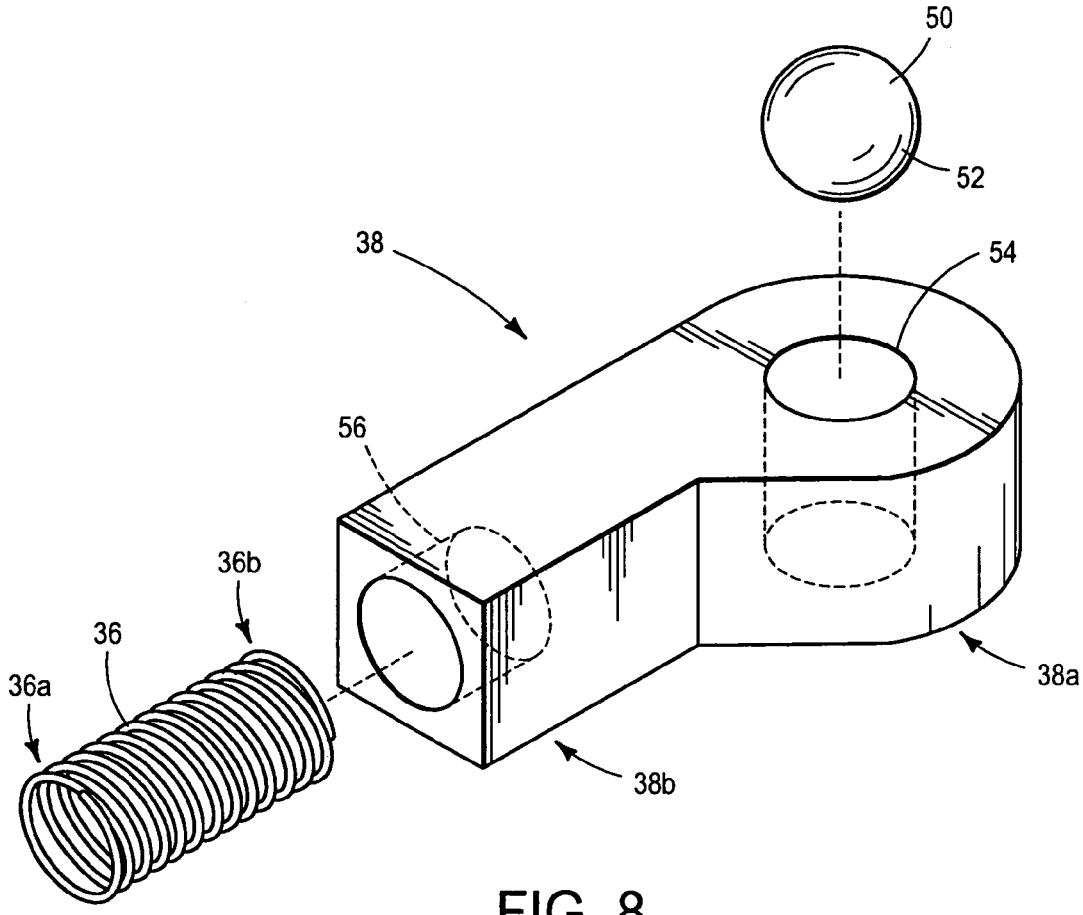
FIG. 8 is an exploded isometric view of a retaining element, a bias element, and an expander as may be used in the embodiment of FIG. 1.
Figure 9:
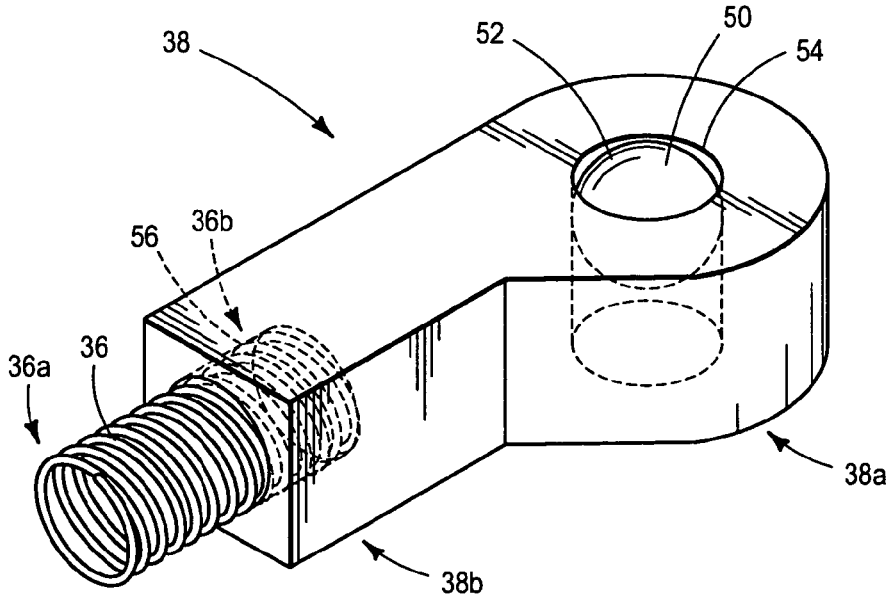
FIG. 9 is an isometric view of the retaining element of FIG. 8 showing the bias element and the expander received in the retaining element.

Locking mechanism 28 also may include a retaining element 38 configured to prevent movement of pin 32*a* in slot 34 from second portion 34*b* into first portion 34*a* of the slot. As shown in FIGS. 8 and 9, retaining element 38 may include a rounded portion 38*a* and an elongate portion 38*b*. The rounded portion may be configured to fit in first portion 34*a* of slot 34, such as by friction fit. The elongate portion may be configured to fit in at least part of second portion 34*b* of slot 34 adjacent to portion 34*a*. Elongate portion 38*b* may be square, rectangular, or any suitable shape in cross section. Although the exemplary retaining element is shown to include elongate and rounded portions, virtually any suitable shape or configuration adapted to prevent pin 32*a* from entering first portion 34*a* of slot 34 may be used.

Rounded portion 38*a* of retaining element 38 may include a hole 54, which may be configured to receive expander 50 and expand retaining element 38. Hole 54 in rounded portion 38*a* may go completely through the rounded portion from one side to the other, or may only partially go through that rounded portion. An expander 50 may be inserted into a hole 54 in retaining element 38 thereby expanding that retaining element, increasing the pressure between the retaining element and the blade surface forming the slot, and/or better securing it in slot 34. Expander 50 may include a ball bearing 52, a rounded pin, and/or any other suitable expander configured to secure the retaining element in slot 34. Elongate portion 38*b* may include a recess 56 configured to receive a bias element, as discussed below.

Furthermore, the locking mechanism may include a bias element 36 configured to urge pin 32*a* of post 32 towards end face 24*c* of handle end 24*a*. The bias element may be configured to urge post 32 toward locking position L. Thus, a user may push post 32 against bias element 36 to move the post into retracted position R.

Bias element 36 may include a first end 36*a* and a second end 36*b*. Bias element 36 may be positioned in slot 34 and secured between blade 22 and pin 32*a* of post 32 to urge the post along the slot towards slot end 34*c* into the locking position. First end 36*a* of bias element 36 may abut pin 32*a* of post 32, while second end 36*b* may abut retaining element 38. First end 36*a* may be trapped between retainers 44, between enlarged knobs 46, or between enlarged ends 48 provided on post 32, or may simply bear against the pin. Second end 36*b* may be received in a recess 56 of elongate portion 38*b*, or may simply bear against that elongate portion. Although bias element 36 is depicted in FIGS. 6-9 as a coiled spring, it may be of any other suitable type of bias element configured to urge the post towards the end face of the handle end, such as wire springs, leaf springs, or other resilient material or structure.

Although the exemplary second locking element 30 discussed includes a post, virtually any other suitable structures, such as latches or hooks, or mechanical, magnetic, or electronic devices, or the like, configured to engage at least part of first locking element 24*b* and selectively lock blade 22 in the open position may be used.

Figure 10:
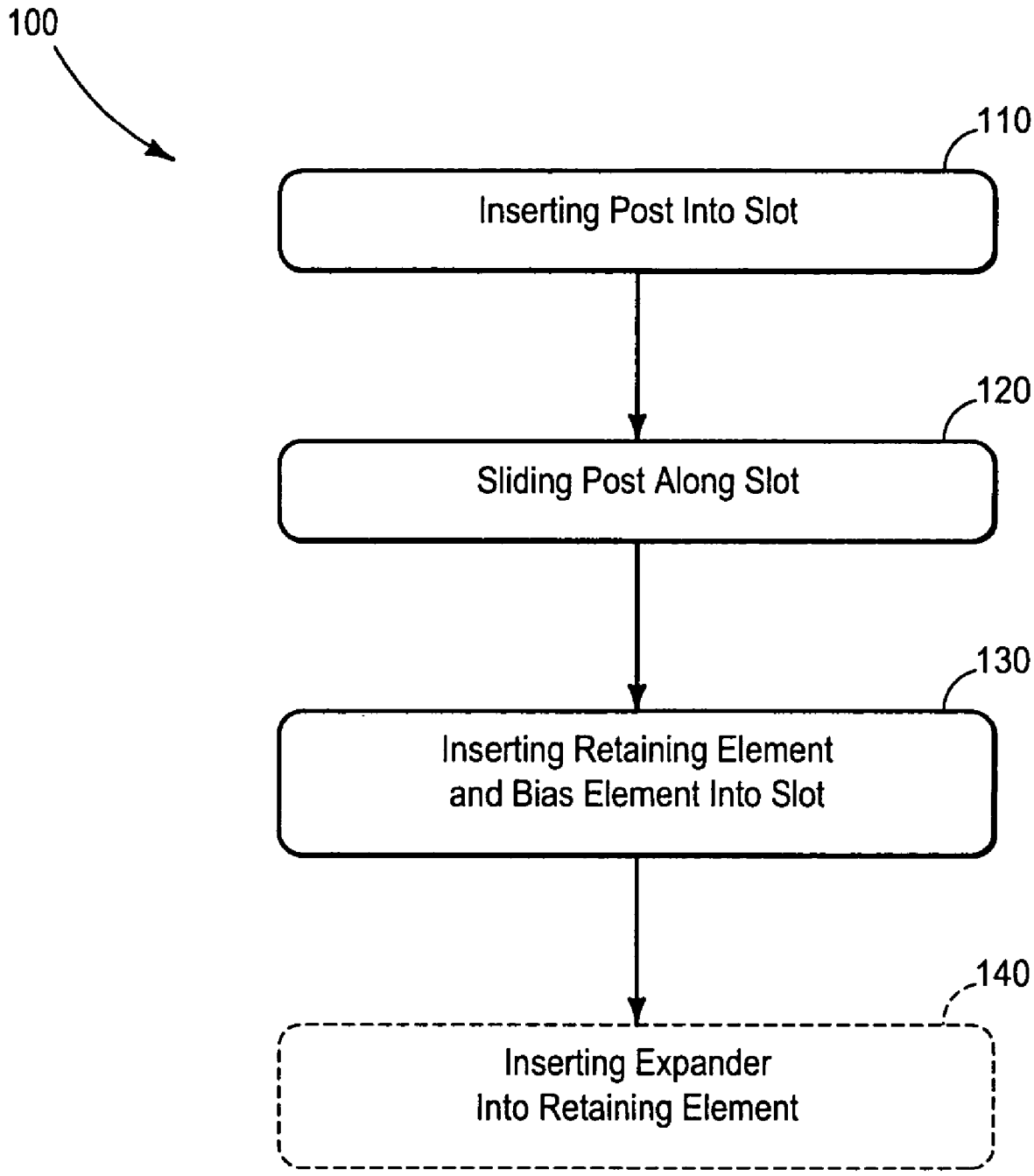
FIG. 10 is a flowchart of a method for assembling a locking mechanism.

FIG. 10 provides a flow chart of a method for assembling a locking mechanism, such as locking mechanism 28, as described above. At 110, the post may be inserted into the first portion of the slot so that each of retainers 44 jut from either side of blade 22. At 120, the post may be slid within the slot along its elongate portion to slot end 34*c*. At 130, the retaining element and the bias element may be inserted into the slot. That insertion may be performed by concurrently inserting both elements, or sequentially inserting either element first. At 140, an expander may be inserted into the retaining element.

Figure 11:
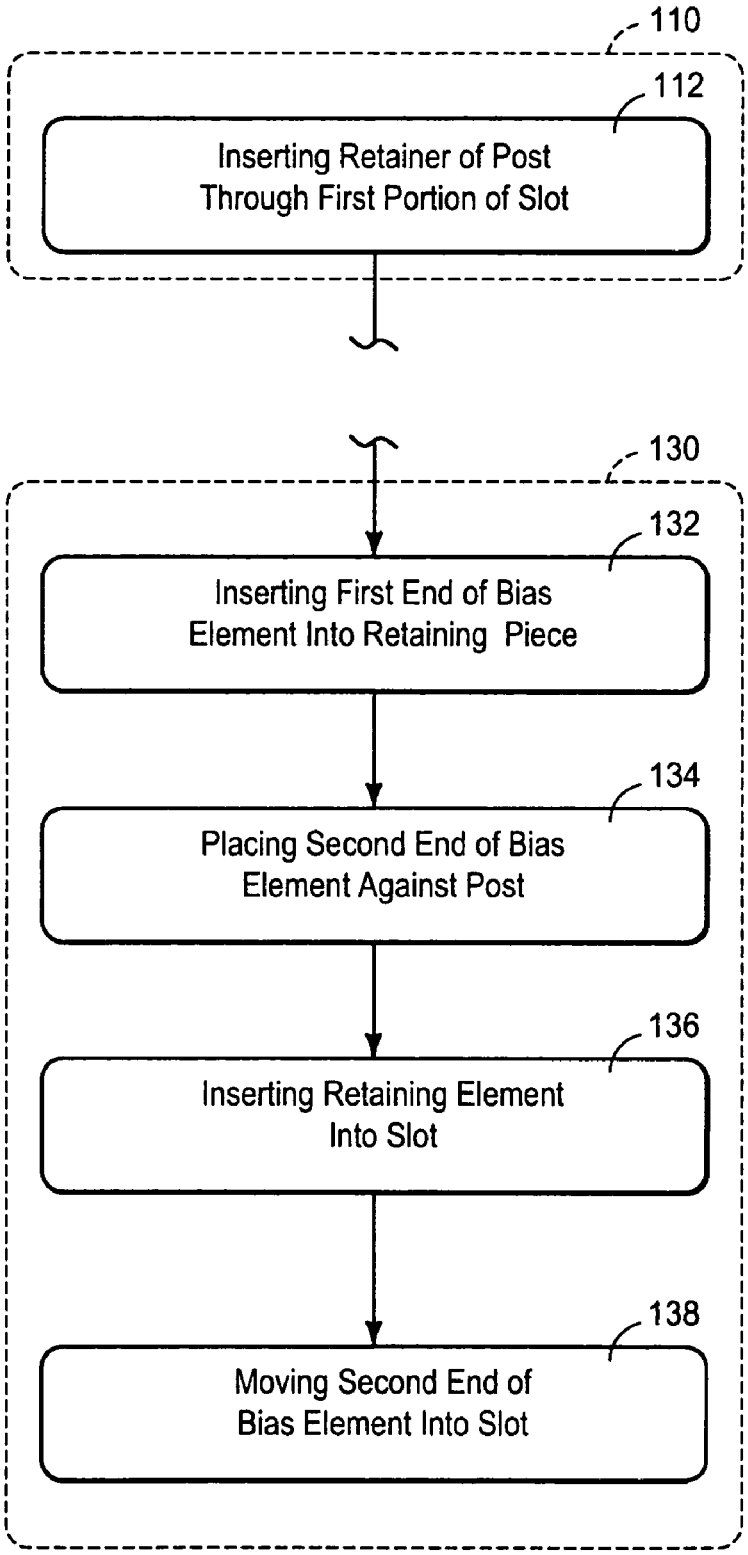
FIG. 11 is a flowchart that provides additional detail of the method illustrated in FIG. 10.

FIG. 11 provides additional detail to portions of flowchart 100 in FIG. 10 in a further and optional example of a method for assembling a locking mechanism, such as locking mechanism 28. Inserting the post may include inserting the retainer of the post through the first portion of the slot at 112. Additionally, or alternatively, inserting the retaining element and the bias element may include inserting the second end of the bias element into the retaining element at 132, placing the first end of the bias element against the post at 134, inserting the retaining element into the slot at 136, and/or moving the first end of the bias element into the slot at 138. Additionally, placing the first end of the bias element against the post may include placing that first end against one of the retainers. Optionally, placing the first end of the bias element may be placed directly against the pin, bypassing step 138. The steps illustrated in FIGS. 10 and 11 may be performed in different sequences and in different combinations, not all steps being required for all examples.

Although the present invention has been shown and described with reference to the foregoing operational principles and preferred embodiments, those skilled in the art will find apparent that various changes in form and detail may be made without departing from the spirit and scope of the invention. The present invention is intended to embrace all such alternatives, modifications, and variances that fall within the scope of the appended claims.

I claim:

1. A folding knife, comprising:

a handle;

a blade coupled at a tang end to the handle so as to be movable between a closed and an open position;

a slot formed in the blade and having first and second ends, the first end and a portion of the slot extending between the first and second ends having a first width, and the second end having a second width greater than the first width;

a retaining element removably positioned within the second end of the slot; and a locking element positioned within the slot and slidable therein while the retaining element is positioned within the second end of the slot, the retaining element preventing the locking element from sliding into the second end of the slot.

2. The folding knife of claim 1 wherein the retaining element comprises an aperture and an expander positioned within the aperture.

3. The folding knife of claim 2 wherein the retaining element extends from the second end of the slot into the portion of the slot extending between the first and second ends.

4. The folding knife of claim 1, comprising a bias element extending within the slot from the retaining element toward the first end of the slot.

5. The folding knife of claim 1, comprising a post extending within the slot and transversely with respect to the blade such that the post is slidable along at least a portion of the length of the slot, the post including a neck having a third width, less that the first width, and further including first and second ends having fourth and fifth widths, respectively, and positioned on respective sides of the blade, each of the fourth and fifth widths being greater than the first width and less than the second width.

6. The folding knife of claim 5 wherein the fourth and fifth widths are equal.

7. The folding knife of claim 5 wherein the neck is substantially cylindrical.

8. The folding knife of claim 5 wherein the slot and post are positioned such that, when the blade is in the open position, the ends of the post can engage a locking feature of the handle, thereby locking the blade in the open position.

9. A folding knife, comprising:

a handle;

a blade pivotably connected to the handle so that the blade is configured to move between a closed position extending along the handle and an open position extending away from the handle, the blade including a slot, the slot including a wide portion and a narrow portion;

a locking mechanism configured to lock the blade in the open position, the locking mechanism including a post having a neck and one or more enlarged ends, the neck being slidably mounted in the slot, and at least one of the one or more enlarged ends being sized to pass laterally through the wide portion of the slot but not through the narrow portion of the slot; and a retaining element positioned in the slot to prevent movement of the neck from the narrow portion of the slot to the wide portion of the slot, and including an elongate portion extending into the narrow portion of the slot.

10. A folding knife, comprising:

a handle including an end face having a first locking element;

a blade pivotably connected to the handle in a manner allowing pivoting of the blade from a closed position in which the blade extends along the handle, to an open position in which the blade extends away from the handle;

a slot in the blade, the slot including a narrow region and an wide region;

a post having first and second knobs, and a neck portion extending between the first and second knobs, the neck portion positioned in the narrow region of the slot for sliding movement along the blade, the post being movable within the narrow region of the slot between a first position in which the post engages at least part of the first locking element in a manner preventing pivoting of the blade relative to the handle, and a second position spaced from the first locking element in which the blade is free to pivot relative to the handle;

a retaining element positioned in the wide region of the slot to prevent movement of the post into the wide portion of the slot the retaining element being configured to expand upon receipt of an expander;

an expander received by the retaining element, whereby the retaining element is secured in the slot; and the end face of the handle being configured such that, as the blade is pivoted from the closed position towards the open position, the post, when in the first position, is spaced from the end face of the handle for at least approximately 75% of the total travel of the blade from the closed position to the open position.

11. A folding knife, comprising:

a handle including an end with an exposed exterior edge surface, the exposed exterior edge surface having a latching corner separated from a remainder of the edge surface by a corner;

a blade pivotably connected to the handle so that the blade is configured to move between a closed position extending along the handle and an open position extending away from the handle, the blade including a slot extending therein and having a first portion and a second portion, the second portion being adjacent to the edge surface when the blade is in the open position;

a post, slidably mounted in the slot;

a retaining element positioned in the first portion of the slot, the retaining element being configured to expand upon receipt of an expander; and an expander received by the retaining element.

12. The folding knife of claim 11, wherein the post includes a pin, and one or more enlarged ends connected to the pin.

13. The folding knife of claim 12, wherein the first portion of the slot is configured to receive the enlarged ends of the pin, the second portion of the slot being configured to enable the pin to slidably engage the latching corner of the handle.

14. The folding knife of claim 11, further comprising a bias element configured to urge the post towards the end of the slot.

15. The folding knife of claim 14, wherein the retaining element supports the bias element in the slot.

16. The folding knife of claim 15, wherein the retaining element includes an elongate portion extending into the second portion of the slot, and the elongate portion supports the bias element.

17. The folding knife of claim 11, wherein the retaining element is secured in the slot by the expander.

18. The folding knife of claim 11, wherein the retaining element includes a hole configured to receive the expander.

19. The folding knife of claim 11, wherein the expander includes a ball bearing.

20. The folding knife of claim 11 wherein the post, while in the second portion of the slot, is spaced from the edge surface such that, during blade motion from the closed position towards the open position, the post does not contact the edge surface until just prior to engaging the latching corner of the exposed exterior edge surface as the blade reaches the open position.

21. A folding knife, comprising:

a handle;

a blade pivotably connected to the handle so that the blade is configured to move between a closed position extending along the handle and an open position extending away from the handle, the blade including a slot, the slot including a wide portion and a narrow portion;

a locking mechanism configured to lock the blade in the open position, the locking mechanism including a post having a neck and one or more enlarged ends, the neck being slidably mounted in the slot, and at least one of the one or more enlarged ends being sized to pass laterally through the wide portion of the slot but not through the narrow portion of the slot; and a retaining element positioned in the slot to prevent movement of the neck from the narrow portion of the slot to the wide portion of the slot, while permitting sliding movement of the neck within the narrow portion of the slot.

22. The folding knife of claim 21, further comprising a bias element configured to urge the post towards an end of the slot.

23. The folding knife of claim 22, wherein the retaining element supports the bias element in the slot.

24. The folding knife of claim 23, wherein the retaining element includes an elongate portion extending into the narrow portion of the slot, and the elongate portion supports the bias element.

25. The folding knife of claim 21, wherein the retaining element is configured to expand upon receipt of an expander, the folding knife further comprising an expander received by the retaining element and configured to secure the retaining element in the slot.

26. The folding knife of claim 25, wherein the retaining element includes a hole configured to receive the expander.

27. The folding knife of claim 25, wherein the expander includes a ball bearing.

28. The folding knife of claim 21, wherein the handle includes an end with an exposed exterior edge surface, the exposed exterior edge surface includes a latching element, and further wherein the at least one of the one or more enlarged ends being configured to engage the latching element of the exposed exterior edge surface when the blade is in the open position.

29. A folding knife, comprising:

a handle including an end face having a first locking element;

a blade pivotably connected to the handle in a manner allowing pivoting of the blade from a closed position in which the blade extends along the handle, to an open position in which the blade extends away from the handle;

a slot in the blade, the slot including a narrow region and an wide region;

a post having first and second knobs, and a neck portion extending between the first and second knobs, the neck portion positioned in the narrow region of the slot for sliding movement along the blade, the post being movable within the narrow region of the slot between a first position in which the post engages at least part of the first locking element in a manner preventing pivoting of the blade relative to the handle, and a second position spaced from the first locking element in which the blade is free to pivot relative to the handle;

a retaining element positioned in the wide region of the slot to prevent movement of the post into the wide region of the slot while permitting movement of the post between the first and second positions; and the end face of the handle being configured such that, as the blade is pivoted from the closed position towards the open position, the post, when in the first position, is spaced from the end face of the handle for at least approximately 75% of the total travel of the blade from the closed position to the open position.

30. The folding knife of claim 29, wherein the first locking element includes a notched corner in the end face of the handle configured to receive the post.

31. The folding knife of claim 29, wherein the knobs are mounted co-axially on the ends of the neck portion of the post.

32. The folding knife of claim 29, further comprising a bias element configured to urge the post towards the end face of the handle.

33. The folding knife of claim 32, wherein the retaining element supports the bias element in the slot.

34. The folding knife of claim 33, wherein the retaining element includes an elongate portion extending into the narrow region of the slot, and the elongate portion supports the bias element.

35. The folding knife of claim 29, wherein the retaining element is configured to expand upon receipt of an expander, the folding knife further comprising an expander received by the retaining element, whereby the retaining element is secured in the slot.

36. The folding knife of claim 35, wherein the retaining element includes a hole configured to receive the expander.

37. The folding knife of claim 35, wherein the expander includes a ball bearing.

* * * * *